US006941654B1

(12) United States Patent
Sears

(10) Patent No.: US 6,941,654 B1
(45) Date of Patent: Sep. 13, 2005

(54) VEHICLE SERVICE BODY

(75) Inventor: Stephen D. Sears, Broken Arrow, OK (US)

(73) Assignee: Auto Crane Company, Tulsa, OK (US)

( * ) Notice: Subject to any disclaimer, the term of this patent is extended or adjusted under 35 U.S.C. 154(b) by 0 days.

(21) Appl. No.: 10/654,730

(22) Filed: Sep. 4, 2003

(51) Int. Cl.[7] ..... B21D 53/88
(52) U.S. Cl. ..... 29/897.2; 296/37.6
(58) Field of Search ..... 29/897.2, 897, 29/897.32; 296/37.6, 24.3, 24.32, 24.4, 24.45, 296/182.1, 191

(56) References Cited

U.S. PATENT DOCUMENTS 2,978,153 A * 4/1961 Brindle ..... 224/541
3,633,970 A * 1/1972 Langhals ..... 296/24.32
3,722,946 A * 3/1973 Cary ..... 296/165
3,799,605 A * 3/1974 Silva ..... 296/165
4,029,355 A 6/1977 Wilhelmsen
5,267,773 A * 12/1993 Kalis et al. ..... 296/183.1
5,351,512 A 10/1994 Pearlman
5,772,271 A 6/1998 Sanders
5,947,549 A 9/1999 Finley
6,006,971 A 12/1999 Coleman et al.
6,131,981 A * 10/2000 Finley ..... 296/37.6
6,237,211 B1 * 5/2001 Clare et al. ..... 29/434
6,354,650 B2 3/2002 Terhaar et al.
6,394,534 B1 5/2002 Dean

OTHER PUBLICATIONS

Warner website pages—4 pages.

* cited by examiner

*Primary Examiner*—David P. Bryant
*Assistant Examiner*—Stephen Kenny
(74) *Attorney, Agent, or Firm*—Chauza & Handley, LLP; Roger N. Chauza

(57) ABSTRACT

A service body for a vehicle includes side packs, each of which is formed with a multi-panel face which includes a side panel, a front panel and a back panel. The panels of the multi-panel face are formed integral by laser cutting the face from a single sheet of metal. L-shaped compartment panels are constructed by forming a compartment divider at right angles to a recessed doorjamb. The recessed doorjambs are welded to the interior surface of the side panel. Top, back and bottom panels are welded to flanged edges of the multi-panel face.

16 Claims, 13 Drawing Sheets

VEHICLE SERVICE BODY

TECHNICAL FIELD OF THE INVENTION

The present invention relates in general to service vehicles, and more particularly to methods of manufacturing side packs for service bodies.

BACKGROUND OF THE INVENTION

Service vehicles are used by a variety of businesses for providing services to customers. A service vehicle usually is a truck of some type, with a truck bed for carrying cargo and storage areas mounted on both sides of the bed. The storage areas are generally metal enclosures called "side packs," with doors for accessing various compartments that can hold or store tools, repairs, supplies, etc. The doors are generally equipped with locks to deter theft of the contents of the compartments.

Often, the side packs are constructed with a tubular or other type of frame substructure, with sheet metal welded thereto. Each panel of the sheet steel is welded to the frame substructure, as are the compartment dividers. While this type of manufacturing technique results in a sturdy and reliable side pack, there are many piece parts that make up the side pack, and substantial labor is involved in cutting the parts from stock material, and in assembling and welding the parts together.

From the foregoing, it can be seen that a need exists for a new and more efficient method for manufacturing side packs for a service vehicle.

SUMMARY OF THE INVENTION

In accordance with the principles and concepts of the invention, there is disclosed a side pack that is efficiently constructed and assembled to provide a cost effective service body.

In accordance with one feature of the invention, the side pack is formed of a number of individual panels, and fixed together with internal welds to provide an aesthetically pleasing unit.

In accordance with another feature of the invention, the front, side and back panels are cut from a single sheet of material as an integral item, and bent to form three outer panels of the side pack. The panels are each formed with inwardly bent flanges around the panel edges for welding thereto the various compartment divider panels.

In accordance with another aspect of the invention, the compartment divider panels have a common top panel welded thereto, and various individual bottom panels welded thereto to enclose the compartments.

In accordance with yet another feature, there is disclosed a method of constructing a multi-compartment side pack for mounting to a vehicle. The method includes the steps of cutting an integral multi-panel face from a sheet of metal, where the multi-panel face including a side panel for the side pack, a front panel for the side pack and a back panel for the side pack. The cutting step includes cutting a plurality of door openings in the side panel. A right angle is formed by bending the multi-panel face between the front panel and the side panel, and forming a right angle bend in the multi-panel face between the side panel and the back panel. The forming step forms the multi-panel face into a U-shaped unit. A plurality of divider panels are fabricated and attached to the side panel to provide compartments. A top panel, a back panel and a bottom panel are attached to the compartments, and doors are provided to cover the openings in the side panel.

With regard to another feature, there is disclosed a method of constructing a multi-compartment side pack for mounting to a vehicle, which includes the steps of cutting an integral multi-panel face from a sheet of metal, where the multi-panel face includes a side panel for the side pack, a front panel for the side pack and a back panel for the side pack. The cutting step includes cutting a plurality of door openings in the side panel. A right angle bend is formed in the multi-panel face between said front panel and the side panel, and a right angle bend is formed in the multi-panel face between the side panel and the back panel. The forming step forms the multi-panel face into a U-shaped unit. A flange is fabricated around portions of a peripheral edge of the multi-panel face. The flange is bent inwardly to form a right angle with the multi-panel face. A plurality of L-shaped panels are fabricated, where each L-shaped panel is fabricated by forming a recessed doorjamb, and forming at a right angle thereto a compartment divider. The recessed doorjambs are attached to the side panel to provide respective compartments. A top panel, a back panel and a bottom panel are attached to the multi-panel face, and doors are provided to cover the openings in the side panel.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
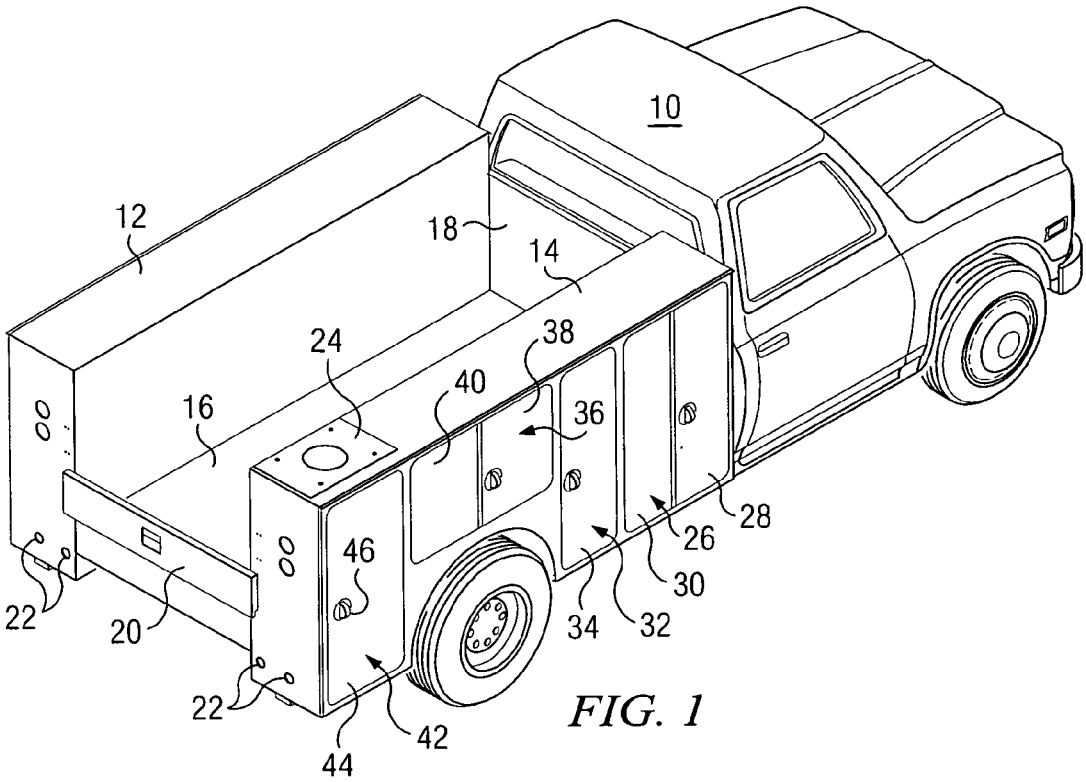
FIG. 1 is an isometric view of a vehicle equipped with side packs.

With reference to FIG. 1, there is shown a truck 10 equipped with side packs 12 and 14 for providing storage for tools, supplies and other items. The side pack 12 is called the street side pack, and the side pack 14 is called the curb side pack. Both side packs 12 and 14 are essentially constructed as mirror image structures. However, those skilled in the art may find that each side pack 12 and 14 can be constructed in a manner tailored to satisfy customer desires. A typical side pack is about 133 inches long, 58 inches tall and 22 inches deep. The side packs 12 and 14 are anchored to the frame of the truck 10, as well as fastened to a truck bed 16 and a bulkhead plate 18. The cargo area of the bed 16 is provided with a tailgate 20 hinged to the bed 16 by conventional hinge mechanisms. The tailgate 20 includes a hand-operated latch for locking the tailgate to the side packs 12 and 14.

When required, the truck 10 can be stabilized by the use of outrigger assemblies (not shown) fastened to the truck frame through holes 22 formed through the side packs 12 and 14. Outriggers are particularly useful when the truck 10 is equipped with a crane (not shown). A crane can be mounted to the curb side pack 14 and to the truck frame, via the top plate 24 of a crane box housed within the curb side pack 14.

Each side pack 12 and 14 is preferably structured to provide independent compartments with lockable doors providing access thereto. In the preferred embodiment of the invention, the side pack 14 includes a front compartment 26 accessed by doors 28 and 30, a mid compartment 32 accessed by door 34, a horizontal compartment 36 accessed by doors 38 and 40, and a rear compartment 42 accessed by door 44. As can be seen, the front compartment 26 and the horizontal compartment 36 are accessed by right/left door pairs, whereas the mid and rear compartments 32 and 42 are accessed by respective single doors 34 and 44. Each compartment has a door that can be locked, preferably by a key. The lock/handle assemblies, one shown as numeral 46, are of standard commercial design where vertical rods engage with the side pack structure to prevent opening of the doors when in a locked condition. When not locked, a handle can be rotated or otherwise manipulated to move the vertical rods out of engagement with the side pack to thereby allow opening of the doors.

As noted above, side packs for trucks have traditionally been constructed with a tubular frame with sheet metal welded thereto. While this construction affords a sturdy side pack, it is not cost effective due to the materials and the time to assemble and weld all the parts together. In accordance with an important feature of the invention, a truck side pack is constructed in a cost effective and efficient manner.

Figure 2:
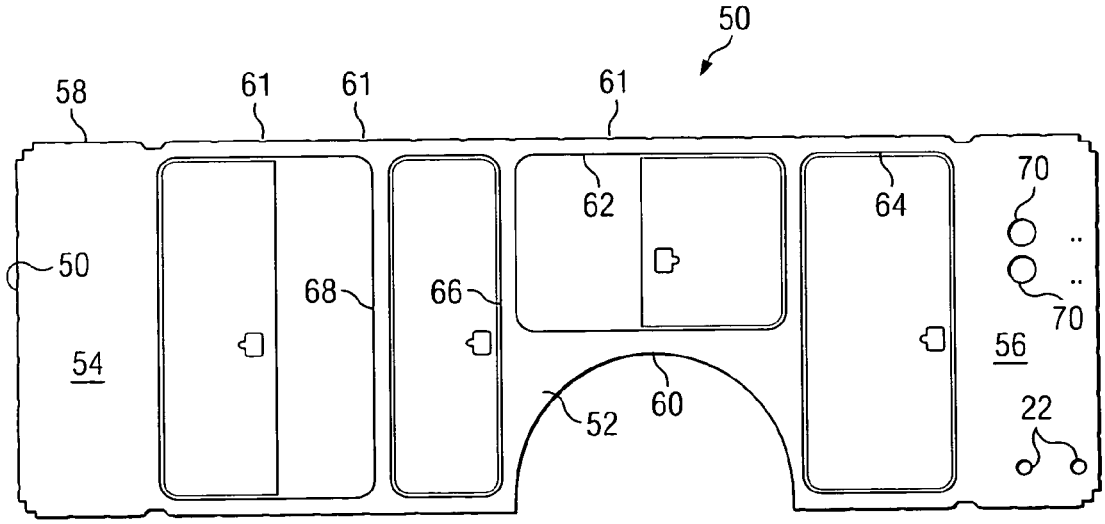
FIG. 2 is a plan view of a multi-panel face of the street side pack.

Referring to FIG. 2, and succeeding figures, there is illustrated the structural and operational features of a street side pack 12, it being understood that the curb side pack 14 is constructed in a very similar manner. In FIG. 2, there is shown a multi-panel face 50 laser cut from a single sheet of metal. The sheet metal employed in constructing both of the side packs 12 and 14 is preferably 10 gauge Galvanneal steel, laser cut with conventional computer controlled metal cutting laser cutting systems. The multi-panel face 50 includes the sheet metal for forming the side panel 52 of the side pack, as well as the front panel 54 and back panel 56. The outline of the multi-panel face 50 is irregular to account for providing a flange 58 therearound, and indentions 61 to define locations for skip welding the parts of the side pack 12 together. Importantly, substantially all welds for fastening the side pack parts together are made to the interior of the side pack so as to be hidden when viewed from the side of the side pack 12. This makes a more aesthetically pleasing structure.

In the pattern for laser cutting the sheet metal, a wheel well 60 is formed below a cutout defining a horizontal compartment door opening 62. A rear compartment door opening 64 is formed, as is a mid compartment door opening 66 and a front compartment door opening 68. These door openings provide access to the respective compartments for storing tools, parts, supplies and many other objects. During the laser cutting operation, openings 70 are cut in the rear panel 56 for mounting therein taillights. The lower openings 22 are for mounting outrigger apparatus through the side pack 12 to the frame of the truck 10. The cut outs forming various of the door openings are used to form the doors themselves. The door construction will be described in more detail below.

Figure 3A:
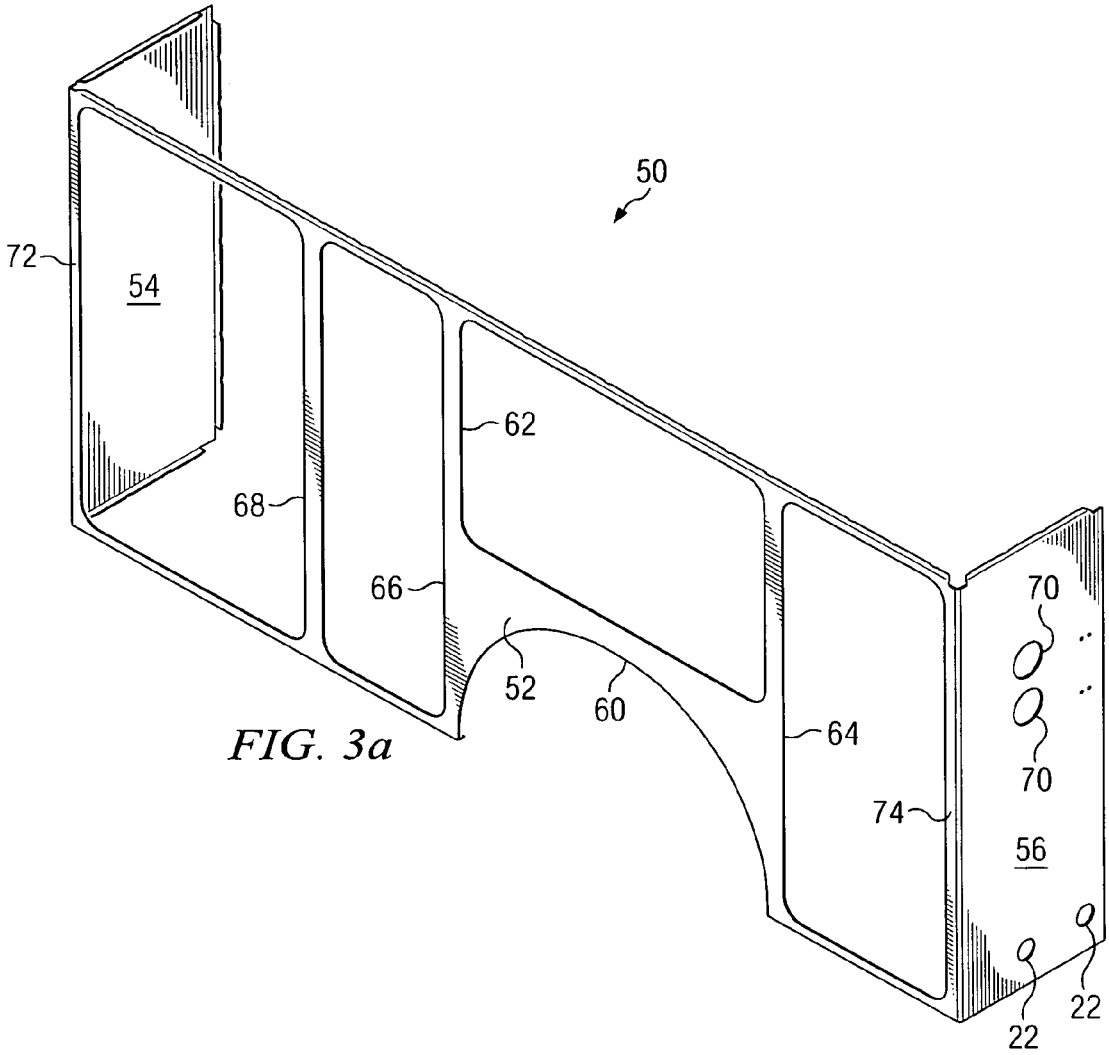
FIG. 3*a* is an isometric view of the multi-panel face after forming bends therein.
Figure 3B:
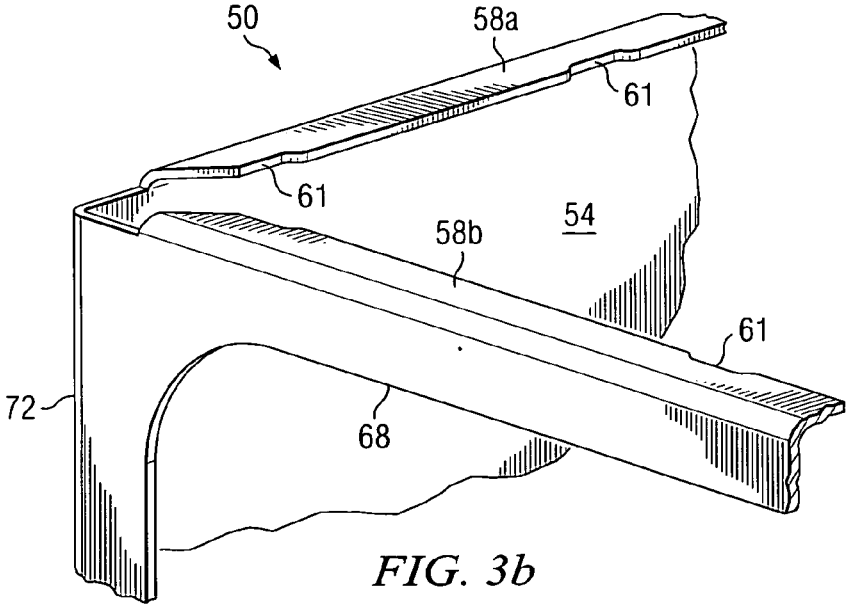
FIG. 3*b* is an isometric view of a portion of the top front left corner of the multi-panel face.

Once all the laser cutting has been carried out to make the multi-panel face 50, the multi-panel face 50 undergoes a bending operation using a press brake. A view of the completed multi-panel face 50 is shown in FIG. 3*a*. In the forming operation, the top, bottom and side flanges 58 are bent at an angle of about 90 degrees with respect to the vertical panels 52, 54 and 56. This is shown in detail in the partial view of the top front corner of the multi-panel face 50 of FIG. 3*b*. Here, the flange 58*a* is shown bent inwardly with a corner radius of about ⅛ inch, and at an angle of about 90 degrees. The indentions 61 are shown in the flanges 58*a* and 58*b* to provide spaced-apart locations for welding the side pack panels together. All of the peripheral edge flanges 58 are bent in a similar manner. Next, two vertical bends 72 and 74 are formed in the multi-panel face 50 to provide a front corner 72 between the front panel 54 and the side panel 52, and to form a back corner 74 between the back panel 56 and the side panel 52.

Figure 3C:
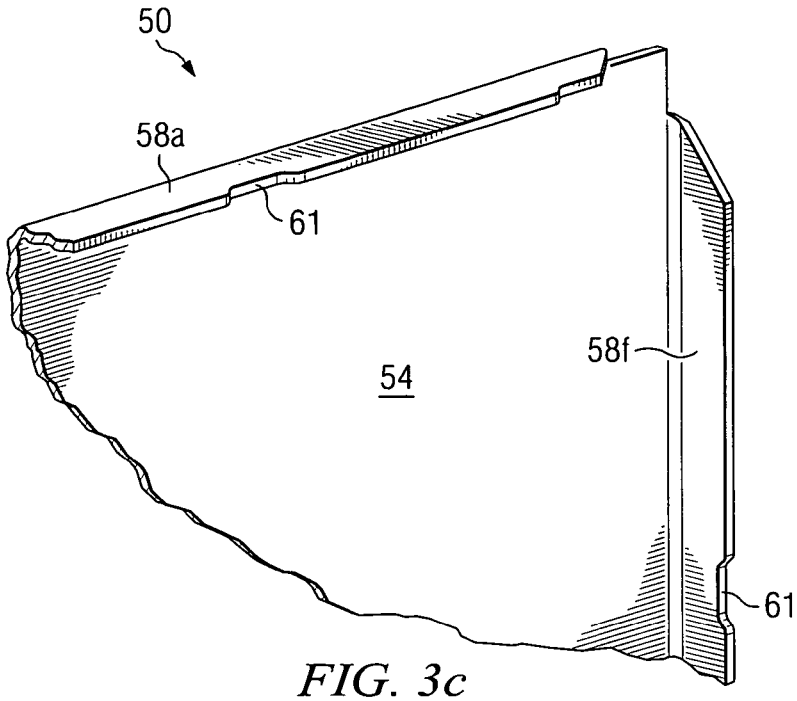
FIG. 3*c* is an isometric view of a portion of the front panel of the multi-panel face.
Figure 3D:
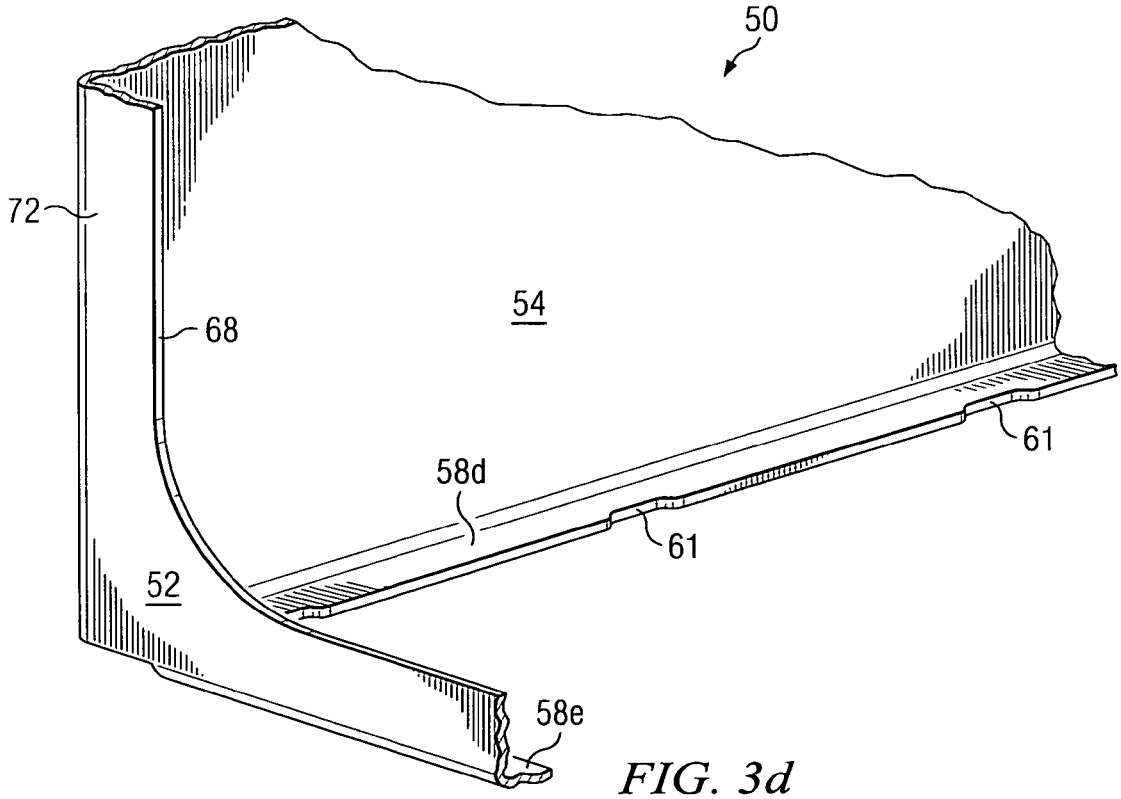
FIG. 3*d* is an isometric view of a portion of the bottom front left corner of the multi-panel face.
Figure 3E:
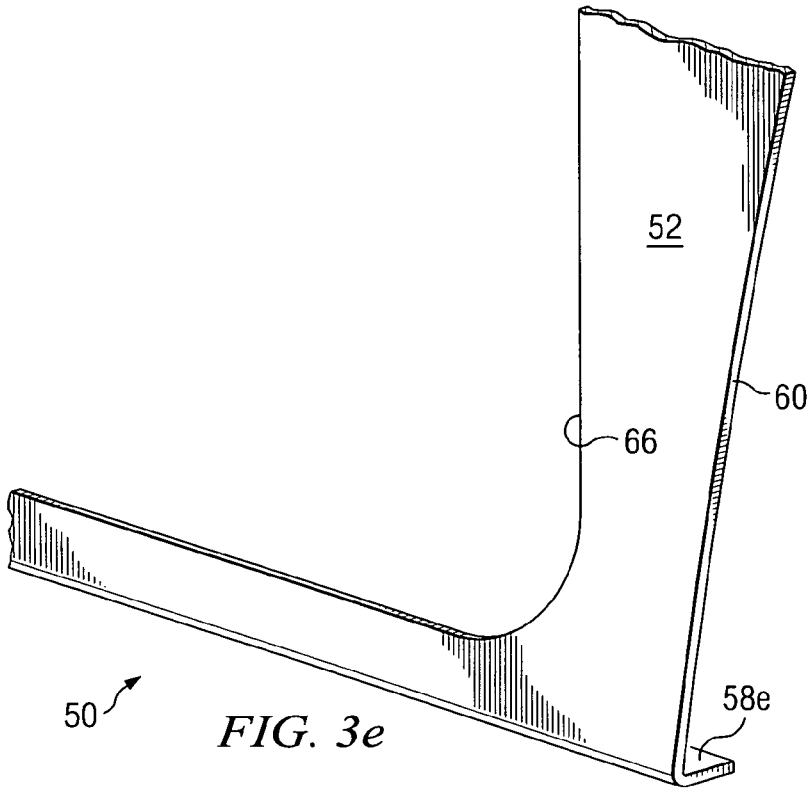
FIG. 3*e* is an isometric view of a portion of the front corner of the wheel well of the multi-panel face.
Figure 3F:
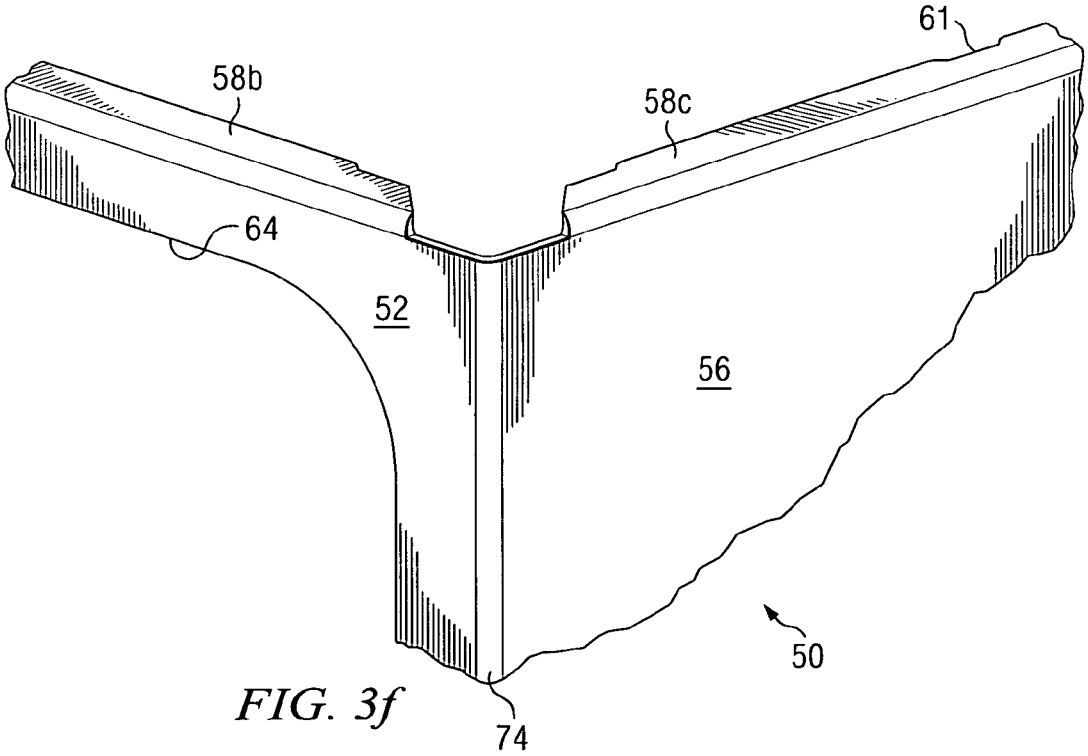
FIG. 3*f* is an isometric view of a portion of the top front right corner of the multi-panel face.
Figure 3G:
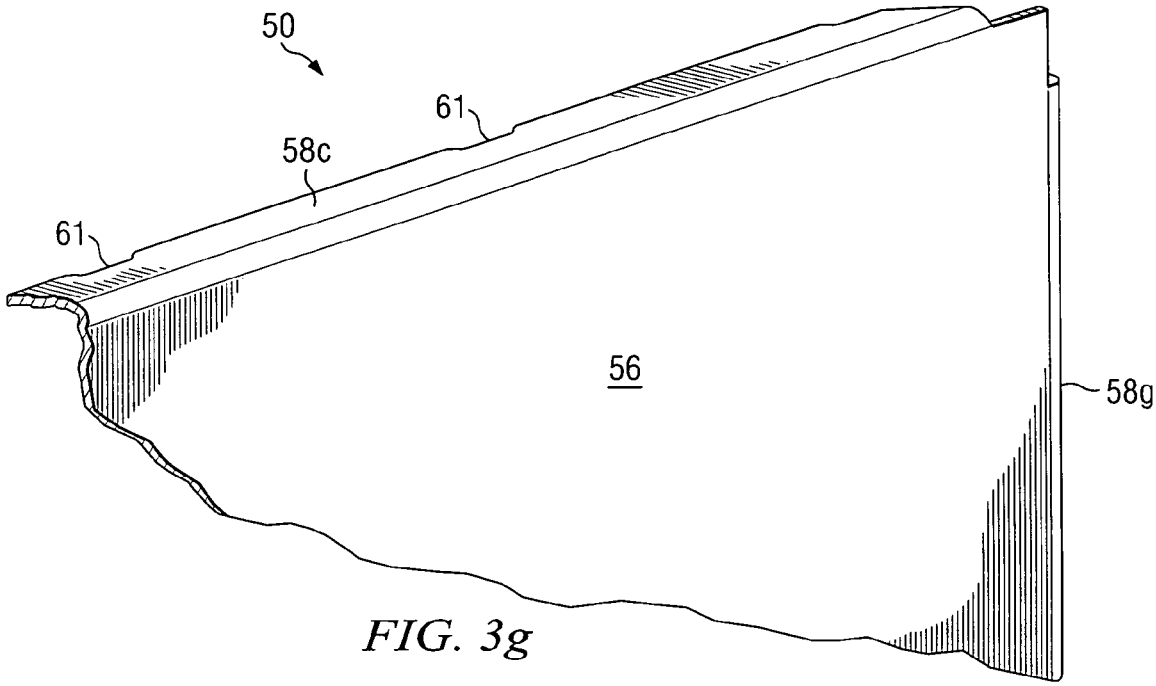
FIG. 3*g* is an isometric view of a portion of the back panel of the multi-panel face.
Figure 3H:
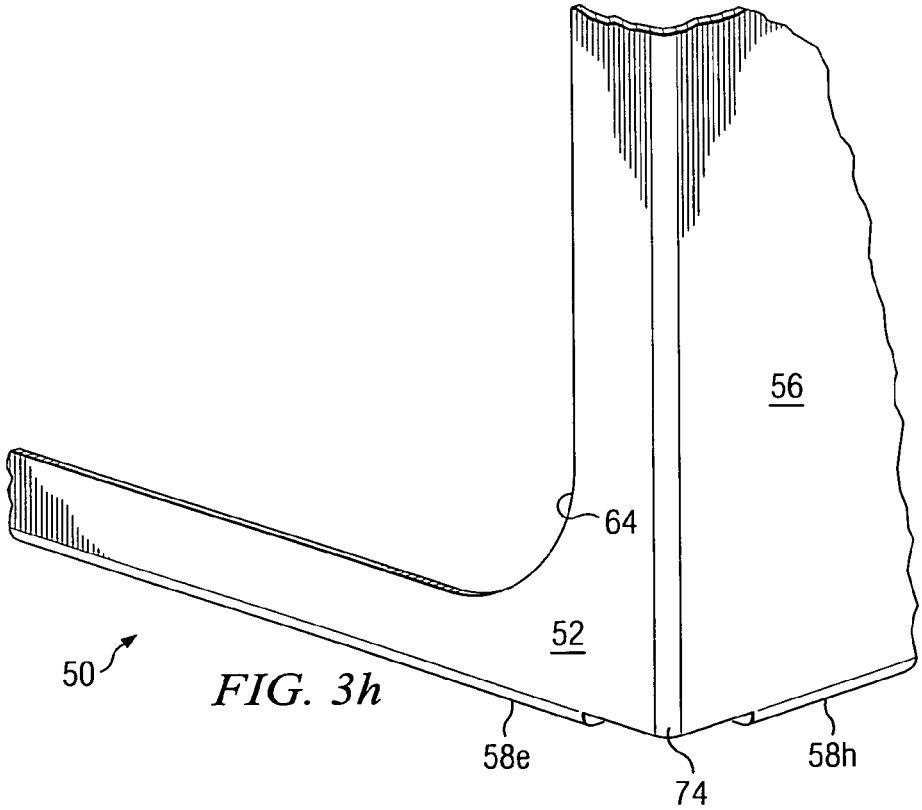
FIG. 3*h* is an isometric view of a portion of the bottom front right corner of the multi-panel face.
Figure 4:
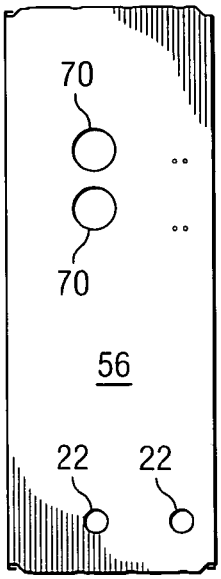
FIG. 4 is a back view of the multi-panel face.
Figure 5:
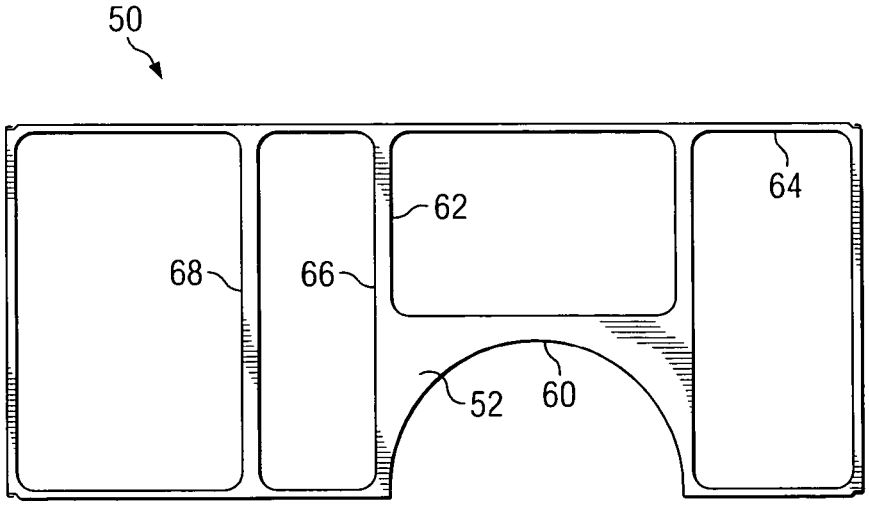
FIG. 5 is a side plan view of the multi-panel face after forming the bends therein.
Figure 6:
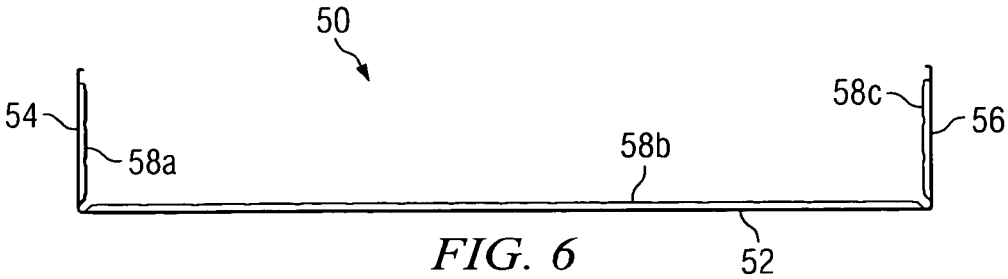
FIG. 6 is a top view of the multi-panel face of FIG. 5.

FIG. 3*c* shows the front panel 54 with the inwardly bent top flange 58*a* and the back flange 58*f*. FIG. 3*d* shows the front bottom corner of the multi-panel face 50 with the inwardly bent flanges 58*d* and 58*e*. FIG. 3*e* shows the side panel 52 with the fender well 60 and the inwardly bent flange 58*e*. FIG. 3*f* shows the back top corner of the multi-panel face 50 with a top flange 58*b* formed on the side panel 52, and a top flange 58*c* formed on the back panel 56. FIG. 3*g* shows the back panel 56 with the top flange 58*c* and the back flange 58*g* formed thereon. FIG. 3*h* shows the structural features of the back bottom corner 74 of the multi-panel face 50. FIG. 5 is a side view of the side panel 52 showing the compartment door openings, and FIG. 6 is a top view of the multi-panel face 50 showing the inwardly bent flanges 58*a*, 58*b* and 58*c*.

Figure 7:
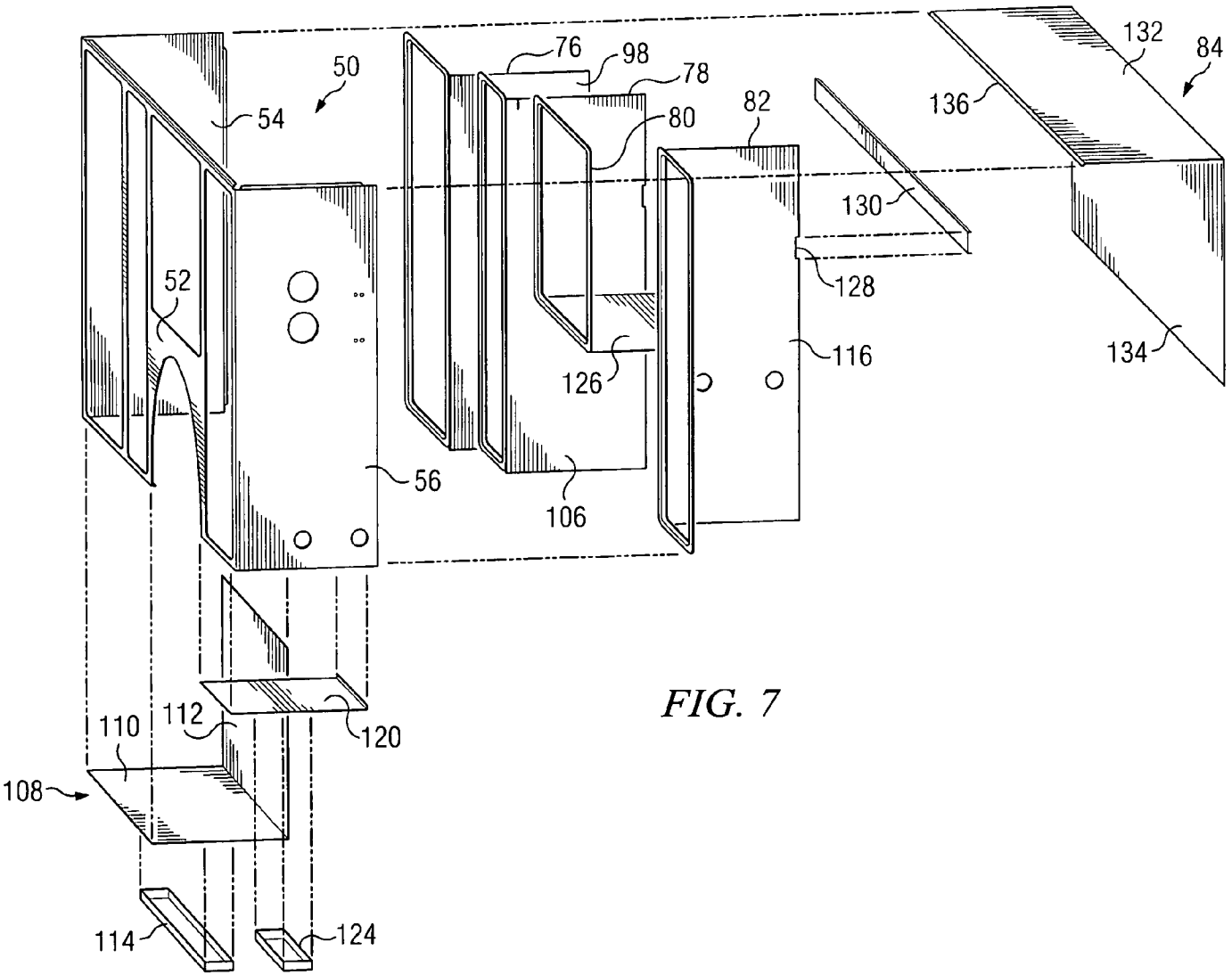
FIG. 7 is an isometric view of the various panels of the street side pack, removed from each other.

In the assembly of the side pack 12, the formed multi-panel face 50 is combined with other formed panels to make the various compartments. The various panels shown in FIG. 7 are removed from each other to illustrate the relative positions and relationships thereof. In the disclosed embodiment, there is a front compartment panel 76, a mid compartment panel 78, a horizontal compartment panel 80 and a rear compartment panel 82. Each compartment panel 76–82 is individually laser cut from respective sheets of Galvanneal metal, and fabricated to include a recessed doorjamb against which a respective compartment door abuts. The details of the front compartment panel 76 are shown in FIGS. 8*a* through 8*e*. The other compartment panels 78, 80 and 82 are fabricated in a similar manner.

Figure 8A:
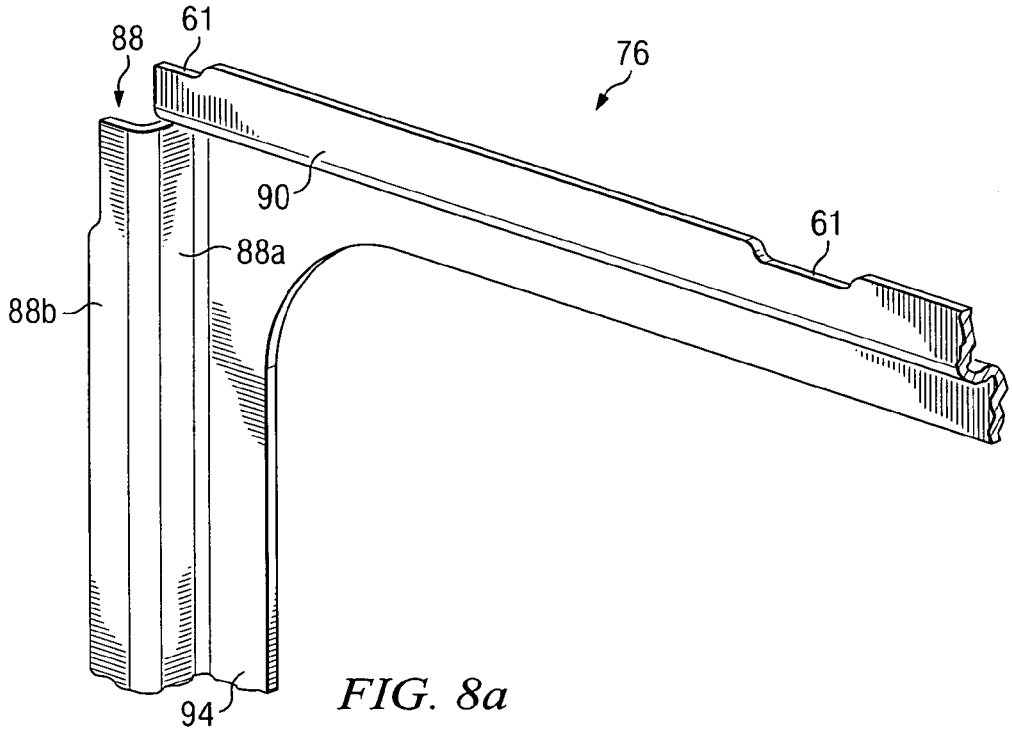
FIGS. 8*a–e* are various isometric views of respective portions of a front compartment panel, showing the detailed structure thereof.
Figure 8B:
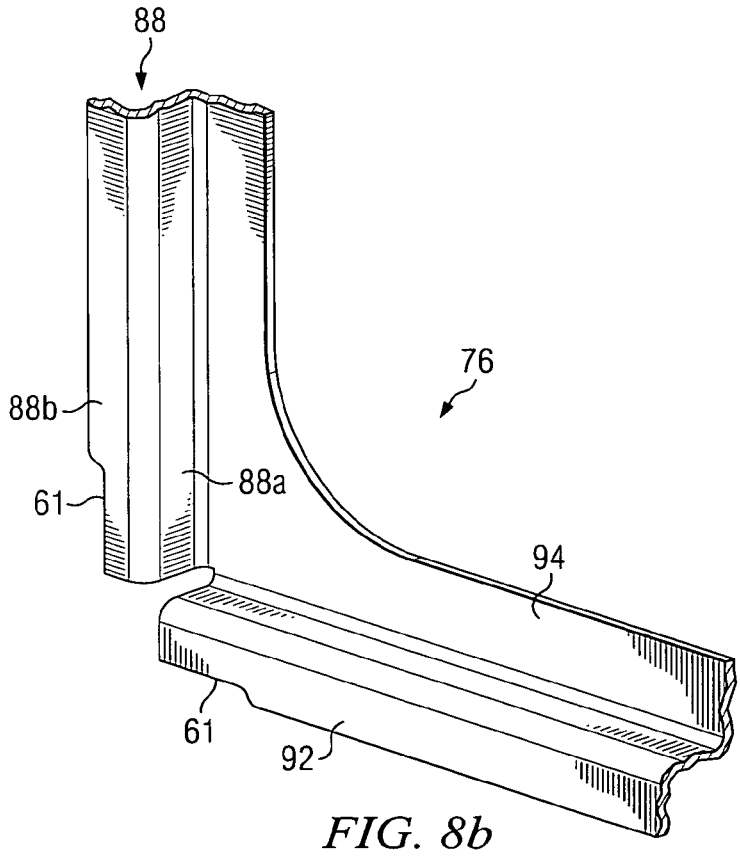
Figure 8C:
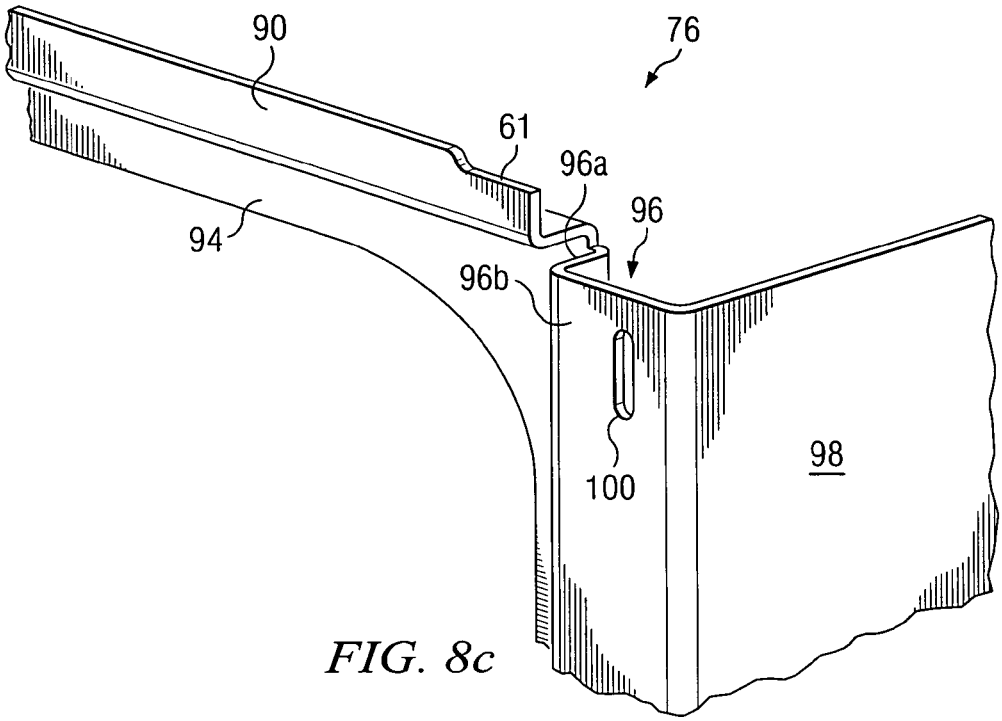
Figure 8D:
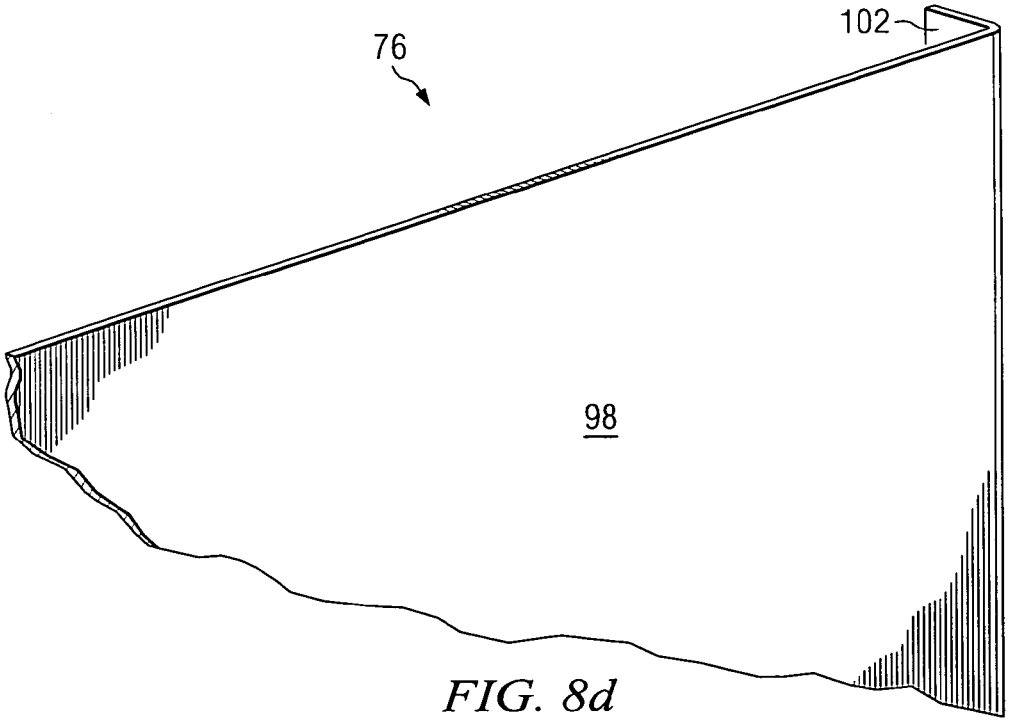
Figure 8E:
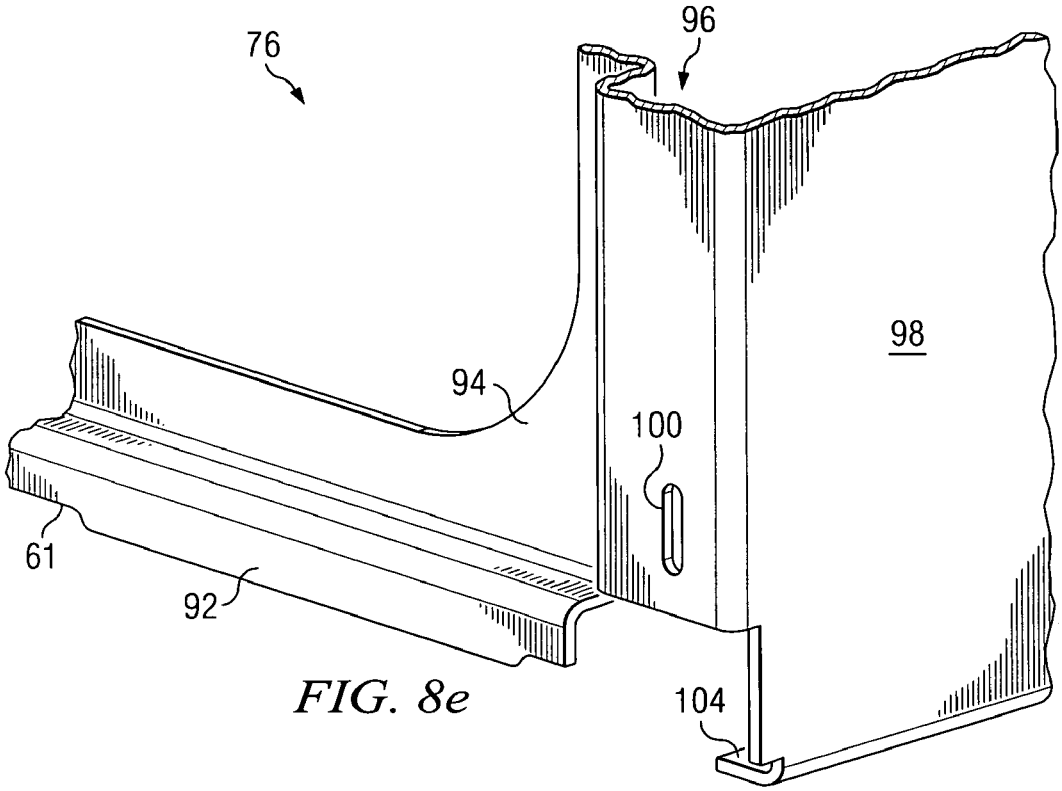

The structure of the upper left corner of the front compartment panel 76 is shown in detain in FIG. 8*a*. A left flange 88 and a top flange 90 are formed as a result of bending the front compartment panel 76. In a similar manner, a bottom flange 92 (FIG. 8*b*) is formed on the bottom portion of the compartment panel 76. The flange 88 has a first part 88*a* bent orthogonal to a recessed doorjamb 94 against which the front door (not shown) abuts. In practice, an elastomeric gasket (not shown) is fastened to the doorjamb 94 to seal the door to the side pack 12. The flange 88 also includes a second part 88*b* that is bent parallel to the recessed doorjamb 94. The second part 88*b* of the left flange 88 includes indentions 61 for use in skip welding the front compartment panel 76 to the inside surface of the side panel 52. The top flange 90 and the bottom flange 92 are fabricated in a similar manner.

The right portion of the front compartment panel 76 includes not only a flange part 96, but also a divider 98. The flange part is fabricated much like the other front compartment flanges 88, 90 and 92, but without the indentions 61. The right flange part 96 includes a part 96*a* bent orthogonal to the recessed doorjamb 94, and a second part 96*b* formed parallel to the recessed door jamb 94. The part 96*b* has a number of vertically spaced-apart slotted holes, one shown as numeral 100, for use in skip welding the divider side of the front compartment panel 76 to the inside surface of the side panel 52.

The divider 98 of the front compartment panel 76 is formed integral to the right flange part 96*b* and extends from top to bottom, and front to back of the street side pack 12. The back edge of the divider 98 includes a flange 102 (FIG. 8*d*) with skip weld indentions (not shown) formed therein. The bottom edge of the divider 98 has a similar flange 104 (FIG. 8*e*) formed thereon. The divider 98 functions to provide a physical separation between the front compartment of the side pack 12 and the mid compartment.

The mid compartment panel 78 shown in FIG. 7 is constructed in a manner similar to the front compartment panel 76 described above, with flange parts for supporting a recessed doorjamb, and a divider 106. The bottom portion of the mid compartment panel 76 forms a part of the wheel well of the side pack 12, and the top portion of the divider 106 provides a physical separation between the horizontal compartment and the mid compartment.

An angled bottom panel 108 of FIG. 7 forms the bottom and a portion of the back of the front and mid compartments. The flange 104 (FIG. 8*e*) formed on the bottom edge of the front compartment divider 98, and a similar flange formed on the mid compartment panel 78 are welded at the indention locations to the horizontal part 110 of the bottom panel 108. The flanges 102 (FIG. 8*d*) formed on the back edge of the front compartment panel divider 98 and the mid compartment panel divider 106 are similarly welded to the vertical part 112 of the bottom panel 108. A support channel 114 is welded centrally under the bottom part 110 of the angled bottom panel 108. The channel 114 provides support to the bottom part 110, and also forms a tray-like structure located under small drain holes cut in the bottom part 110. This allows any moisture that may have seeped into the front compartment to escape out of the holes and drain out of the channel support 114.

Figure 9:
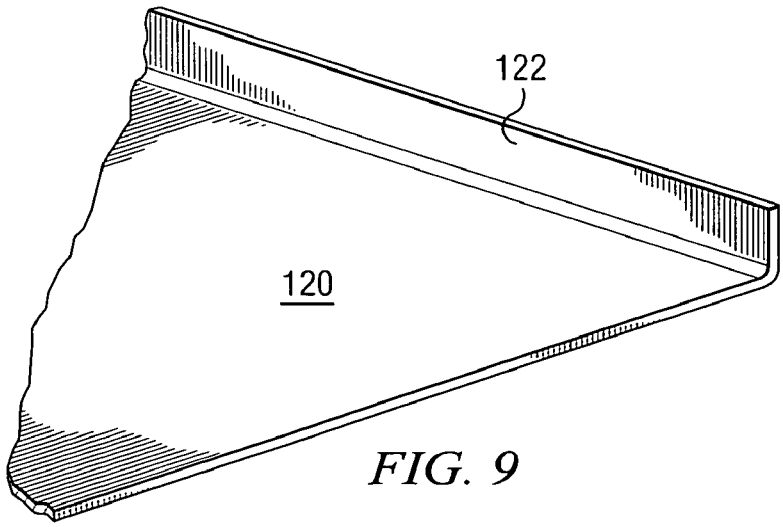
FIG. 9 is an isometric of a portion of a bottom panel showing the back edge configuration.

The rear compartment panel 82 is formed in a manner very similar to the front compartment panel 76 described above. To that end, the rear compartment panel 82 includes flanges, flange parts, a recessed doorjamb, and a divider 116. The divider 116 forms a part of the wheel well, as well as a physical separation between the rear compartment and the horizontal compartment. The rear compartment assembly includes a bottom panel 120 that is welded to the flange formed on the bottom edge of the rear compartment panel divider 116, as well as welded to the flange 58*e* formed on the bottom edges of the side panel 50, and flange 58*h* formed on the bottom of the back panel 56. The bottom panel 120 includes an upturned lip 122, as shown in enlarged detail in FIG. 9. A channel support 124 is welded under the bottom panel 120 to provide support and a drain tray very much like that described above in connection with the support channel 114 of the bottom panel 108 associated with the front and mid compartments.

The horizontal compartment panel 80 includes flange parts supporting a recessed doorjamb, much like that described above in connection with the front compartment panel 76. The horizontal compartment does not include any side dividers, but does include a bottom 126, shown in FIG. 7. The bottom 126 has an upturned flange (not shown) formed on the back edge thereof.

Each vertical divider, such as front compartment panel divider 98, mid compartment panel divider 106 and rear compartment panel divider 116, includes a cutout formed on the back edge thereof. One cutout is shown as numeral 128 formed in the rear compartment panel divider 82. The cutouts in the three dividers accommodate an elongate lateral channel support 130. The lateral channel support 130 stiffens the back side of the side pack 12.

Figure 10:
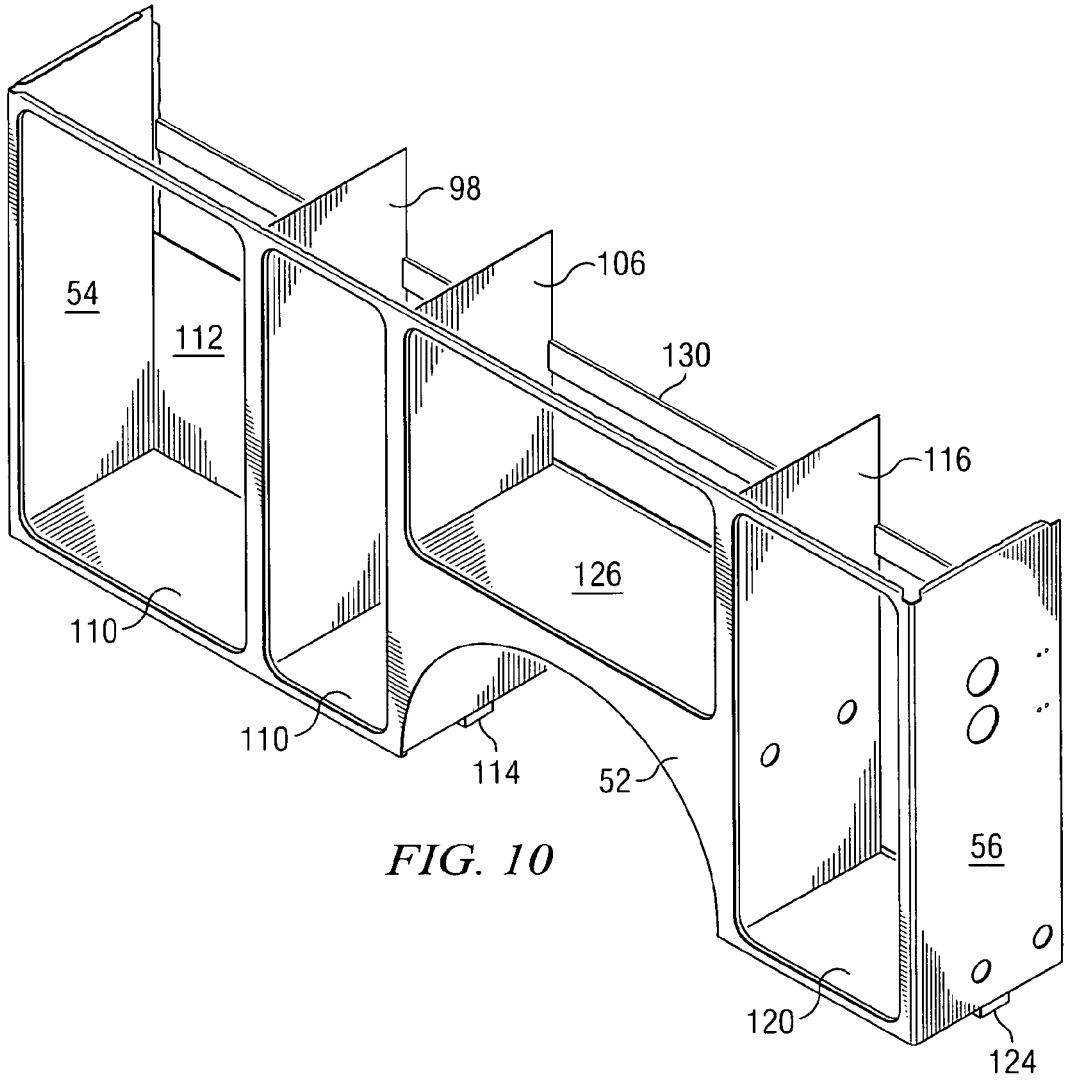
FIG. 10 an isometric view of the street side pack as partially assembled.
Figure 11:
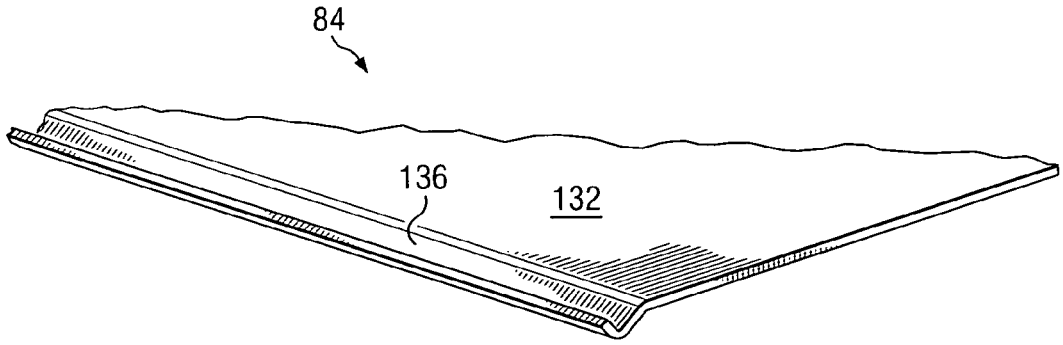
FIG. 11 is an isometric view of a portion of the top panel.
Figure 12:
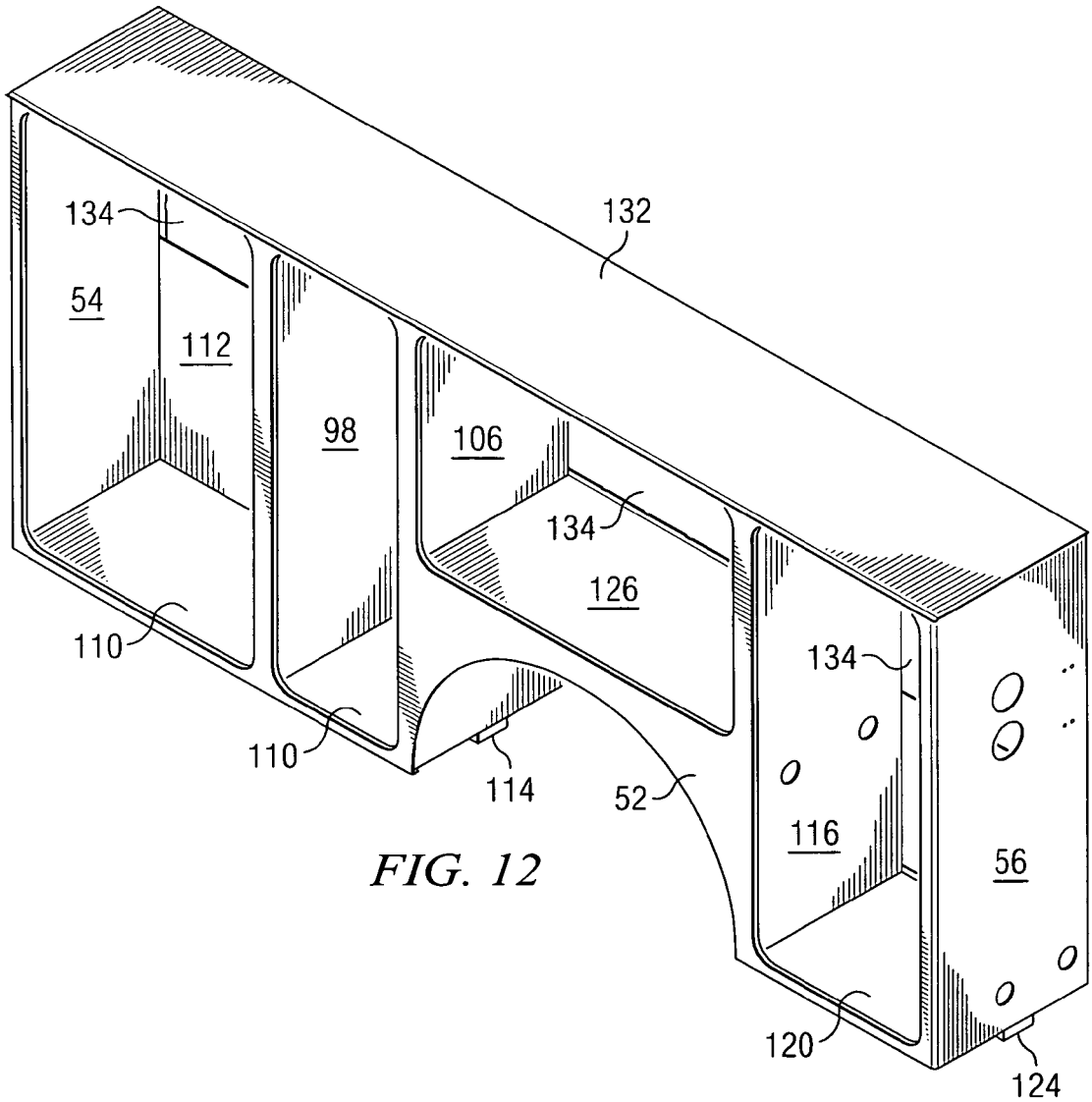
FIG. 12 is an isometric view of a street side pack fully assembled, except for the various doors.

When the side pack 12 has been assembled and welded in accordance with the foregoing, the side pack structure appears as shown in FIG. 10. The completion of the assembly is carried out by welding an angled top panel 84 (FIG. 7) to the assembly of FIG. 10. The angle top panel 84 includes a planar horizontal top part 132 and a planar vertical back part 134. A partial sectional view of the top part 132 is shown in FIG. 11. Here, there is illustrated the formation of a drip rail 136 for directing runoff water along the length of the side pack 12 to the front or back, rather than down over the compartment doors. The angled top panel 84 is welded to the corresponding flanges of the side panel 50 as well as the flanges of the compartment panels. The side pack assembly then appears as illustrated in FIG. 12. During the latter stages of assembly and attachment of the service body to the vehicle chassis, elastomeric fenders can be attached to the side panel 52 around the fender well 60.

It is noted that the lower portion of the back of the rear compartment is not initially covered with a panel during assembly. This bottom opening in the back of the back compartment allows access to the vehicle chassis for welding structural supports between the chassis and the side packs. It should be noted that in the assembly of the vehicle service body, the street and curb side packs are welded to the cargo bed 16 and the bulkhead 18 to form an integral unit. Thereafter, the entire service body unit is mounted to the vehicle chassis. During assembly of the vehicle service body, various jigs and fixtures are employed to hold the parts in place for subsequent welding.

The side pack doors are of a cabinet style in terms of hinge location. However, those skilled in the art may find that in certain situations, the hinges can be located at the top or bottom of the doors. The hinges utilized are of conventional design, where one half of each hinge is mounted to the side pack structure, and the other half of the hinge is welded to the door itself. Conventional door latch mechanisms are also utilized. Accordingly, because the door hinges and the latch mechanisms are not part of the invention, they are not discussed any further.

Figure 13:
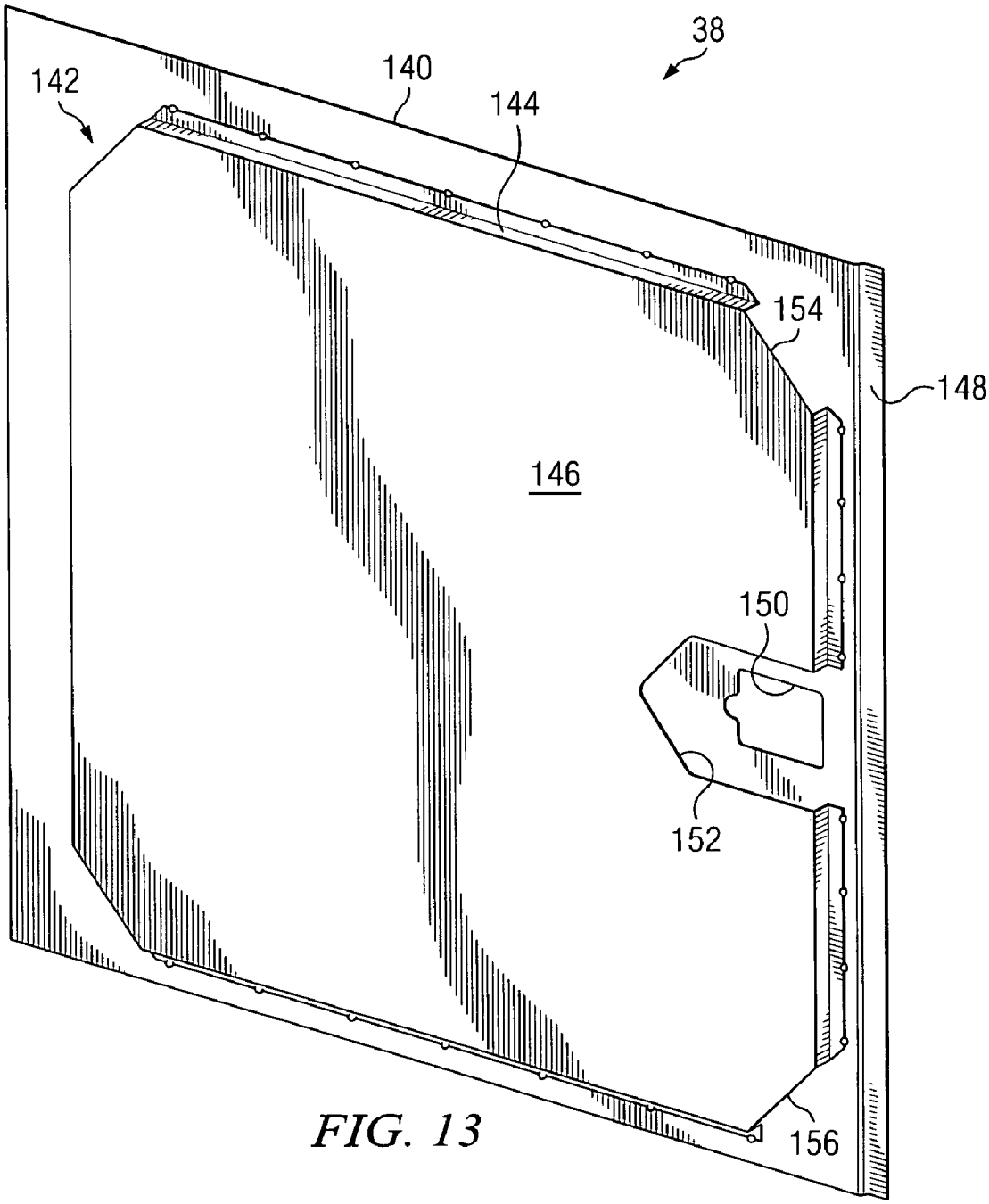
FIG. 13 is an isometric view of the construction of a door used with the side pack.

FIG. 13 illustrates the structural features of the horizontal compartment door 38, as viewed from the back side thereof. The other doors of the side pack 12 are constructed in a similar manner. It is noted that the door 38 includes an outer panel 140 and an inner panel 142 spot welded thereto. The inner panel 142 has a peripheral flange 144 that allows a central part 146 to be spaced from the surface of the outer panel 140. A stiff and structurally rugged door is thus made. Importantly, the outer panel 140 is that part of the material cut out of the side panel 52 in forming the door opening 62 for the horizontal compartment. The outer panel 140 is bent at the edge opposite the hinge edge to form an offset edge 148 to overlap the corresponding edge of the partner door 40 of the horizontal compartment. The partner door 40 has an outer panel cut from fresh metal stock.

The door 38 includes a latch opening 150 cut therein for mounting therein a hand-operated latch (not shown). An opening 152 is formed in the inner panel 142 to allow installation of the latch in the outer panel opening 150. The corners of the inner panel 142 are cut on a diagonal, as shown.

Except for size, the other door 28 of the front compartment is formed in the same manner. The other single doors 34 and 44 that have latches are formed in substantially the same manner, except they have no offset edges 148. Lastly, the other doors 30 and 40 of the side pack 12 that are not themselves of the latching type, are made in a similar manner, except that no latch openings or offset edges 148 are formed in the outer or inner panels.

With respect to the curb side pack 14, a crane can be mounted thereto, in the space occupied by the rear compartment. As noted above, the plate 24 provides reinforcement to the side pack 14 to support the pedestal of the crane. In addition, a crane box (not shown) is welded inside the rear compartment to provide support between the top plate 24 and the frame of the truck 10. The crane box extends between the top and bottom of the rear compartment, and is constructed of steel in the shape of an elongate square box. Many types and designs of crane supports can be employed in lieu or in addition to the crane box.

In order to make the compartments of the side packs compatible with the needs of the customer, various attachments, shelves, hangers, hooks, etc., can be fastened within the respective compartments. As noted above, once the side packs 12 and 14 are completed, together with the cargo bed 16 and the bulk head 18, the unit is placed on the truck frame and fastened thereto. Any exposed unwelded seams in the side packs 12 and 14 can be sealed with an all-weather sealant. The entire service body unit can then be painted.

While the preferred and other embodiments of the invention have been disclosed with reference to specific side pack structures, it is to be understood that many changes in detail may be made as a matter of engineering choices without departing from the spirit and scope of the invention, as defined by the appended claims.

What is claimed is:

1. A method of constructing a multi-compartment side pack for mounting to a vehicle, comprising the steps of:

cutting an integral multi-panel face from a sheet of metal, said multi-panel face including a side panel for said side pack, a front panel for said side pack and a back panel for said side pack, said cutting step including cutting a plurality of door openings in said side panel;

forming a right angle bend in said multi-panel face between said front panel and said side panel, and forming a right angle bend in said multi-panel face between said side panel and said back panel, said forming step forming said multi-panel face into a U-shaped unit;

fabricating a plurality of divider panels, and attaching said divider panels to said side panel to provide compartments;

attaching a top panel, a back panel and a bottom panel to the compartments; and providing doors to cover the openings in said side panel.

2. The method of claim 1, further including forming an inwardly bent flange on at least a portion of a peripheral edge of said multi-panel face, and fastening the top panel, back panel and bottom panel to said flange, said inwardly bent flange formed by bending material of said multi-panel face.

3. The method of claim 1, further including fabricating said divider panels to each include a respective divider panel formed orthogonal to a doorjamb frame, and forming a peripheral flange around said doorjamb frame, and fastening the peripheral flange of the doorjamb around a respective opening of said side panel.

4. The method of claim 3, further including forming the peripheral flange and doorjamb frame of each said divider panel so that the respective doorjamb frame is spaced from the back surface of said side panel.

5. The method of claim 1, further including fixing the panels together by welding.

6. The method of claim 5, further including making all welds between said multi-panel face and said divider panels in respective locations that are not visible from outside said side pack.

7. The method of claim 1, further including using a cutout obtained from making one said door opening, to fabricate a door panel for covering a portion of one said door opening.

8. The method of claim 7, further including welding a flanged reinforcing panel to a backside of said cutout, and bending one side edge of said cutout to form an offset edge.

9. The method of claim 8, further including forming a partner door panel, and mounting said door panel and said partner door panel so as to cover said one opening in said side panel, and mounting said door panel and said partner door panel in said door opening so that the offset edge of said door panel overlaps a side edge of said partner door panel.

10. The method of claim 1, further including forming a first side pack for mounting to a curb side of the vehicle, and forming a second side pack for mounting to a street side of said vehicle.

11. The method of claim 10, further including welding the first and second side packs to a bed of said vehicle, and welding said first and second side packs to a front bulkhead of said vehicle.

12. A method of constructing a multi-compartment side pack for mounting to a vehicle, comprising the steps of:

cutting an integral multi-panel face from a sheet of metal, said multi-panel face including a side panel for said side pack, a front panel for said side pack and a back panel for said side pack, said cutting step including cutting a plurality of door openings in said side panel;

forming a right angle bend in said multi-panel face between said front panel and said side panel, and forming a right angle bend in said multi-panel face between said side panel and said back panel, said forming step forming said multi-panel face into a U-shaped unit;

fabricating a flange around portions of a peripheral edge of the multi-panel face, said flange being bent inwardly to form a right angle with said multi-panel face;

fabricating a plurality of L-shaped panels, each L-shaped panel fabricated by forming a recessed doorjamb, and forming at a right angle thereto a compartment divider, and attaching the recessed doorjambs to said side panel to provide respective compartments;

attaching a top panel, a back panel and a bottom panel to the multi-panel face; and providing doors to cover the openings in said side panel.

13. The method of claim 12, further including welding the L-shaped panels to the back surface of said side panel so that no welds are visible as viewed from the side of the side panel.

14. A method of constructing a multi-compartment side pack for mounting to a vehicle, comprising the steps of:

cutting an integral multi-panel face from a sheet of metal, said multi-panel face including a side panel for said side pack, a front panel for said side pack and a back panel for said side pack, said cutting step including cutting a plurality of door openings in said side panel;

forming a vertical right angle bend in said multi-panel face between said front panel and said side panel, and forming a vertical right angle bend in said multi-panel face between said side panel and said back panel, said forming step forming said multi-panel face into a U-shaped unit;

fabricating a first L-shaped panel having a front compartment divider formed at a right angle with respect to a first doorjamb, said front compartment divider forming a side of a front compartment with the front panel of said multi-panel face;

fabricating a second L-shaped panel having a mid compartment divider formed at a right angle with respect to a second doorjamb, said mid compartment divider forming a side of a mid compartment with said front compartment divider;

fabricating a third L-shaped panel having a bottom panel formed at a right angle with respect to a third doorjamb, said bottom panel forming a bottom for a horizontal compartment;

fabricating a fourth L-shaped panel having a rear compartment divider formed at a right angle with respect to a fourth doorjamb, said rear compartment divider forming a side of a rear compartment with the back panel of said multi-panel face;

fabricating a top panel having a top part formed orthogonal to a back part, said top part for fastening to said multi-panel face, said back part forming at least a portion of a back side of said front, mid, horizontal and rear compartments of said side pack;

an angled bottom panel having a bottom part forming a bottom of said front and mid compartments, and a vertical part forming at least a portion of a back side of said front and mid compartments;

fabricating a bottom panel, said bottom panel forming a bottom for said rear compartment; and providing doors to cover the openings in said side panel of said multi-panel face, said doors abutting against respective said doorjambs.

15. The method of claim 14, wherein each said doorjamb provides a peripheral abutment all around each respective said door opening.

16. The method of claim 14, further including forming a wheel well under said horizontal compartment.

* * * * *